US006685072B2

(12) United States Patent
Ho

(10) Patent No.: US 6,685,072 B2
(45) Date of Patent: Feb. 3, 2004

(54) KNAPSACK HAVING A BACK WALL FORMED WITH SPACERS

(75) Inventor: Chin-Lien Ho, No. 36, Lo-Yang Rd., Hsi-Tun Dist, Taichung City (TW)

(73) Assignee: Chin-Lien Ho, Taichung (TW)

( * ) Notice: Subject to any disclaimer, the term of this patent is extended or adjusted under 35 U.S.C. 154(b) by 45 days.

(21) Appl. No.: 10/091,995

(22) Filed: Mar. 5, 2002

(65) Prior Publication Data

US 2003/0168488 A1 Sep. 11, 2003

(51) Int. Cl.[7] ..... A45F 3/04; A45F 3/08; A45F 3/10

(52) U.S. Cl. ..... 224/629; 224/645; 224/657

(58) Field of Search ..... 224/629, 630, 224/644, 645, 657, 628, 642, 153

(56) References Cited

U.S. PATENT DOCUMENTS 5,361,955 A * 11/1994 Gregory ..... 224/211
5,573,155 A * 11/1996 Sadler ..... 224/155
5,588,569 A * 12/1996 Mitomi et al. ..... 224/153
5,894,977 A * 4/1999 Krueger et al. ..... 224/627
5,911,348 A * 6/1999 Shook ..... 224/629

FOREIGN PATENT DOCUMENTS

DE 19526764 A1 * 1/1997
FR 2646998 A1 * 11/1990

* cited by examiner

*Primary Examiner*—Sue A. Weaver
(74) *Attorney, Agent, or Firm*—Merchant & Gould, P.C.

(57) ABSTRACT

A knapsack is made of a hard thermoplastic material and is molded into a single-piece construction. The knapsack has a rear wall surface facing toward a user's back and formed with a plurality of spacers to result in a spacing between the rear wall surface and the user's back. As a result, the knapsack does not attach closely to the user's back and, therefore, permits air ventilation and can provide a massaging effect.

3 Claims, 3 Drawing Sheets

KNAPSACK HAVING A BACK WALL FORMED WITH SPACERS

BACKGROUND OF THE INVENTION

1. Field of the Invention

This invention relates to a knapsack, more particularly to a knapsack which can be produced at a relatively low cost, which permits air ventilation when carried on a user's back, and which can massage the user's back.

2. Description of the Related Art

Conventional knapsacks are mostly made from fabric or polyurethane rubber materials in order to provide comfort during use. While such knapsacks permit air ventilation and are comfortable when placed in contact with a user's back due to their softness, these materials are relatively expensive. Moreover, these knapsacks require hard support boards placed therein or supportive reinforcement strips formed therearound in order to prevent the contents from being damaged or piled up disorderly and the deformation of the knapsacks. In addition, since such knapsacks require extra time for sewing, the production costs are increased as well. Furthermore, damaged or broken knapsacks that are made from fabric or polyurethane rubber materials could not be easily recycled. Hence, a serious problem in environmental protection arises therefrom.

SUMMARY OF THE INVENTION

Therefore, the object of the present invention is to provide a knapsack which can be produced at a relatively low cost, which permits air ventilation when carried on a user's back, and which can massage the user's back.

A knapsack according to this invention comprises a sack body defining an accommodation space for receiving articles therein, and including a back wall which has a front wall surface confronting said accommodation space, and a rear wall surface opposite to the front wall surface and adapted to face toward a user's back; and a plurality of spacers which are disposed on said rear wall surface, which are spaced apart from each other, and which extend away from said front wall surface so as to space said rear wall surface apart from the user's back, said spacers being molded integrally with said back wall to form a single-piece construction.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
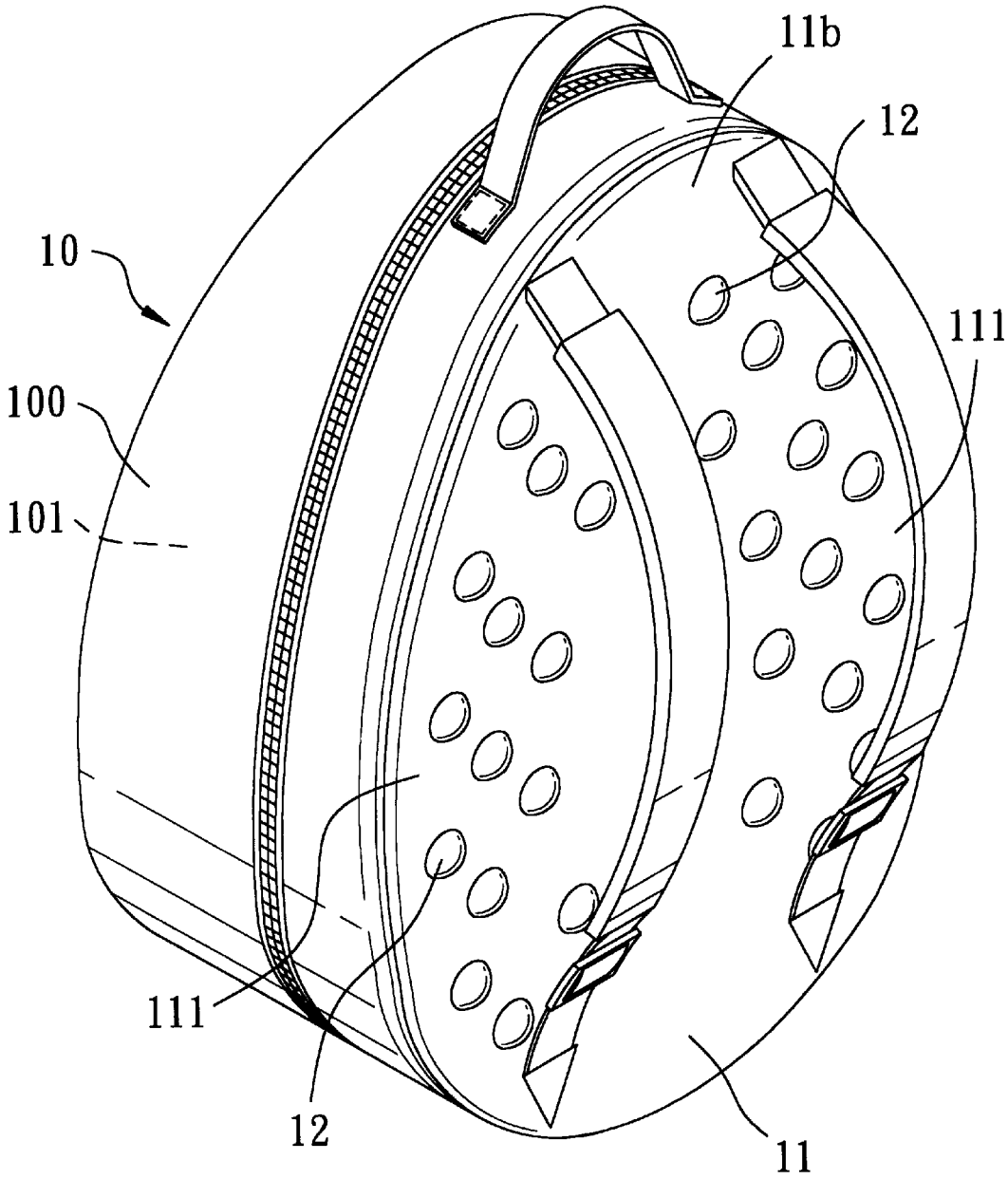
FIG. 1 is a perspective view of a preferred embodiment of a knapsack according to this invention.
Figure 2:
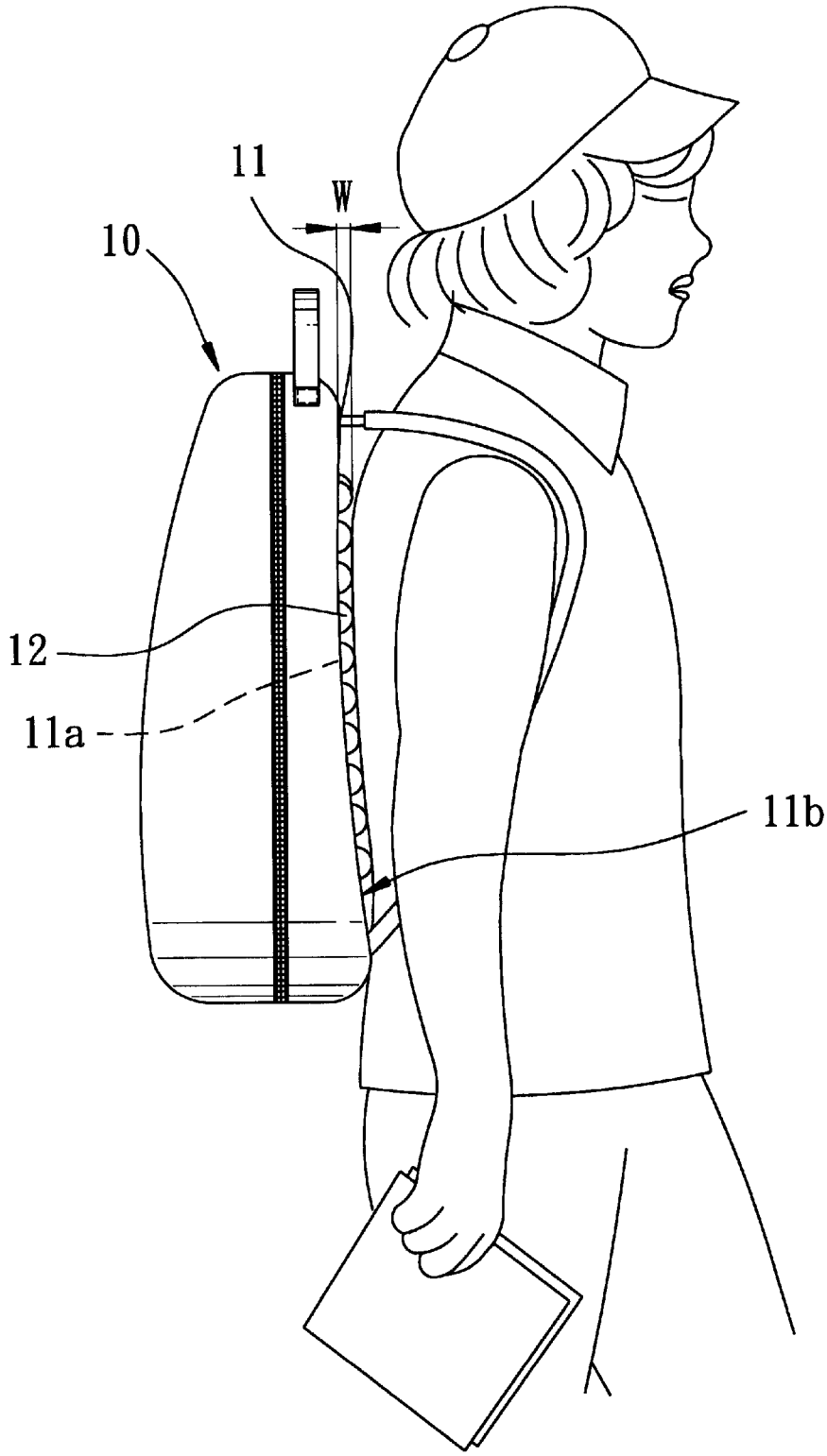
FIG. 2 is a side view showing the preferred embodiment when carried on a user's back.
Figure 3:
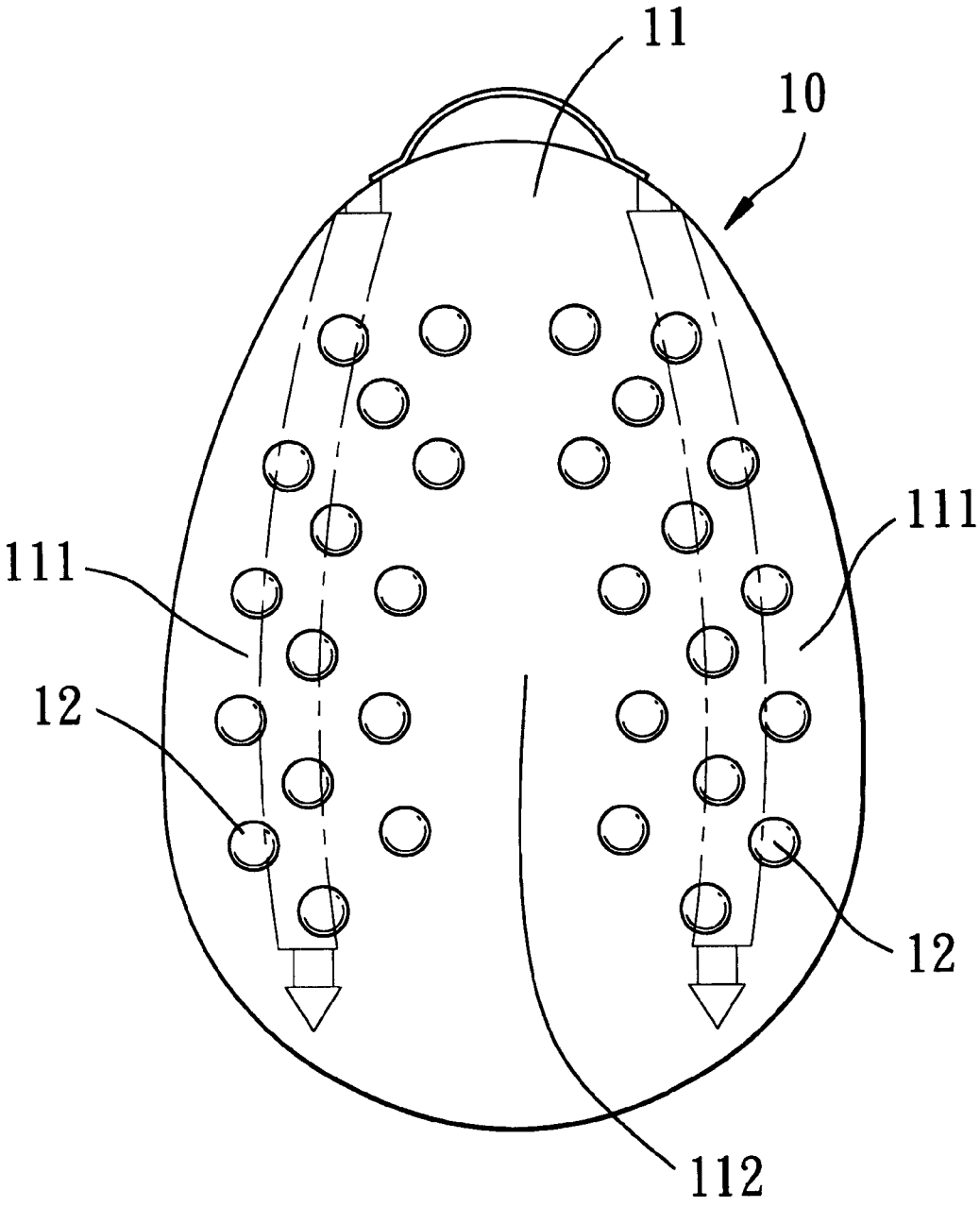
FIG. 3 is a rear view of the preferred embodiment.

Referring to FIGS. 1, 2 and 3, the preferred embodiment of the knapsack 10 according to the present invention is made from a hard thermoplastic material, such as polypropylene, polystyrene, acrylonitrile-butadiene-styrene, and polyvinyl chloride, and is molded integrally into a single-piece construction. The knapsack 10 comprises a sack body 100, which defines an accommodation space 101 for receiving articles therein, and which includes a back wall 11 having a front wall surface 11*a* confronting the accommodation space 101, and a rear wall surface 11*b* opposite to the front wall surface 11*a* and adapted to face toward a user's back. In addition, the rear wall surface 11*b* of the back wall 11 has a plurality of spacers 12 disposed thereon. The spacers 12 are convex, preferably hemispherical. The spacers 12 extend away from the front wall surface 11*a* and space the rear wall surface 11*b* apart from the user's back, thereby forming a clearance (w) between the rear wall surface 11*b* and the user's back for air ventilation. Preferably, the spacers 12 are distributed on the left and right sections 111 of the rear wall surface 11*b* and are not provided on the middle section 112 of the rear wall surface 11*b* to prevent the spacers 12 from rubbing against a user's vertebra.

Moreover, the material for making the knapsack according to the present invention could include infrared-minerals, such as infrared-magnet, etc., for therapeutic purposes.

In summary, the following are some of the advantages of the knapsack 10 according to the present invention. First, since the knapsack 10 is made from a hard thermoplastic material and is molded into a single-piece construction, it requires less production time and reduces the time for sewing, thereby resulting in lower production costs. Second, since spacers 12 are formed on the rear wall surface lib to contact the user's back, the spacers 12 not only space the rear wall surface 11*b* apart from the user's back for air ventilation, but also provide a massaging effect. Finally, the spacers 12 can enhance aesthetics appeal of the knapsack 10.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A knapsack comprising:

a sack body defining an accommodation space for receiving articles therein, and including a back wall which has a front wall surface confronting said accommodation space, and a rear wall surface opposite to said front wall surface and adapted to face toward a user's back; and a plurality of spacers which are disposed on said rear wall surface, which are spaced apart from each other, and which extend away from said front wall surface so as to space said rear wall surface apart from the user's back, said spacers being molded integrally with said back wall to form a single-piece construction;

wherein said spacers are generally hemispherical.

2. A knapsack according to claim 1, wherein said back wall and said spacers are made from a thermoplastic material.

3. A knapsack according to claim 1, wherein each of said spacers is made from a material and is of a dimension such that when said sack body is carried on the user's back, said spacers are forced to press on the user's back, thereby providing a massaging effect.

* * * * *